United States Patent [19]

O'Brien

[11] Patent Number: 4,464,323

[45] Date of Patent: Aug. 7, 1984

[54] PROCESS FOR PREPARING HIGH STRENGTH CELLULOSIC FIBERS

[75] Inventor: John P. O'Brien, Wilmington, Del.

[73] Assignee: E. I. Du Pont de Nemours and Company, Wilmington, Del.

[21] Appl. No.: 406,533

[22] Filed: Aug. 9, 1982

[51] Int. Cl.[3] ..... D01F 2/00

[52] U.S. Cl. ..... 264/187; 106/178; 106/196; 264/210.8

[58] Field of Search ..... 264/205, 207, 187, 210.8; 106/163 R, 196, 203, 178

[56] References Cited

U.S. PATENT DOCUMENTS 4,357,389 11/1982 Satoh ..... 428/372
4,370,168 1/1983 Kamide et al. ..... 106/177

FOREIGN PATENT DOCUMENTS 2340344 2/1977 France .
763489 7/1978 U.S.S.R. .

OTHER PUBLICATIONS

J. Poly Sci., 19, 1449–1460, (1981).
J. Poly Sci., 20, 1019–1028, (1982).
Kirk-Othmer, Encycl. of Chem. Tech., 5, 3rd Ed., pp. 89–117.

*Primary Examiner*—Jay H. Woo

[57] ABSTRACT

High strength, high modulus cellulose triacetate fibers are produced by spinning a 30–42% by weight solution of cellulose triacetate having an acetyl content of at least 42.5% and an inherent viscosity of at least 5 from a solvent mixture comprising trifluoroacetic acid and another solvent having a molecular weight of less than 160 in a mol ratio of 0.3–3.0 through an air gap into a coagulating bath. The fibers are optionally heat treated under tension or saponified to provide high strength high modulus regenerated cellulose fibers.

9 Claims, 4 Drawing Figures

PROCESS FOR PREPARING HIGH STRENGTH CELLULOSIC FIBERS

This invention concerns a new cellulose triacetate fiber, a new regenerated cellulose fiber, and methods for making these fibers from optically anisotropic solutions of cellulose triacetate.

BACKGROUND OF THE INVENTION

Anisotropic spinning solutions from aromatic polyamides have been described in Kwolek U.S. Pat. No. 3,671,542 and in U.S. Pat. No. Re. 30,352. These solutions (dopes) are useful in making aramid fibers of very high tenacity and modulus.

More recently optically anisotropic solutions of cellulosic materials have been described in French Pat. No. 2,340,344, and these too have provided high tenacity/-high modulus fibers. The ever-increasing costs of petrochemicals gives increasing impetus to the study of fibers from renewable sources, such as the cellulosics. In particular cellulosic fibers with properties approaching the aramid properties have been sought. Considerable effort has been applied to the use of optically anisotropic solutions to obtain the desired properties, but heretofore this effort has not been successful in providing cellulosic fiber property levels beyond about 6.8 dN/tex tenacity for cellulose triacetate or about 9.6 dN/tex tenacity for regenerated cellulose, both as described in Example 6 of French Pat. No. 2,340,344.

In the cellulose textile field it has been proposed that higher DP (degree of polymerization) should provide improved properties in the resulting fibers or films but it has not been possible to accomplish this goal because of the extremely high viscosity of the solutions. Anisotropic solutions provide the opportunity for spinning at high concentrations without excessive viscosities, but prior to the present invention adequate solvents for forming high concentration solutions of high DP cellulose triacetate have not been available.

SUMMARY OF THE INVENTION

The invention provides as-spun cellulose triacetate fibers having at least 42.5% by weight acetyl groups, a tenacity of at least 8 dN/tex, an orientation angle (OA) of 35° or less, and an inherent viscosity of at least 5, preferably at least 6.3.

The invention further includes the above cellulose triacetate fibers which have been heat-treated in steam under tension and which have an orientation angle of 20° or less, a tenacity of at least 10.6 dN/tex, and a modulus of at least 155 dN/tex. The invention also provides a regenerated cellulose fiber having an orientation angle of 18° or less, a tenacity of at least 12.4 dN/tex, and a modulus of at least 220 dN/tex. The regenerated cellulose fibers are optionally heat treated to provide an orientation angle of 10° or less.

The process of the invention provides a high strength cellulose triacetate fiber by air-gap spinning an optically anisotropic solution comprising (1) 30 to 42% by weight of cellulose triacetate having an inherent viscosity in hexafluoroisopropanol at 0.5 g/dL of at least 5 and a degree of substitution equivalent to at least 42.5% by weight acetyl groups and (2) 58 to 70% by weight of a solvent mixture comprised of an organic acid having a $pK_a$ of less than 3.5, preferably, less than 1.0, and another solvent having a molecular weight less than 160, the molar ratio of the organic acid to the other solvent being from 0.3 to 3.0, preferably 1.0 to 2.5, the anisotropic solution being spun through an inert non-coagulating fluid layer into a bath comprising a one-to-three-carbon alcohol or diol, preferably methanol, the coagulated yarn from the bath being washed in water to extract remaining solvent and then dried. Preferably the organic acid is trifluoroacetic acid (TFA). Optionally the extracted yarn is heat-treated by stretching 1 to 10% in steam, thereby providing a yarn of higher modulus.

Another aspect of the invention concerns saponification of the as spun high tenacity cellulose triacetate yarn and optionally, heat treating under tension to provide a regenerated cellulose yarn with tenacity of at least 12.4 dN/tex and modulus above 220 dN/tex.

The fibers are useful in ropes and cordage, tire cords and other uses requiring high tensile strength and high modulus.

THE DRAWINGS

TESTS

Figure 1:
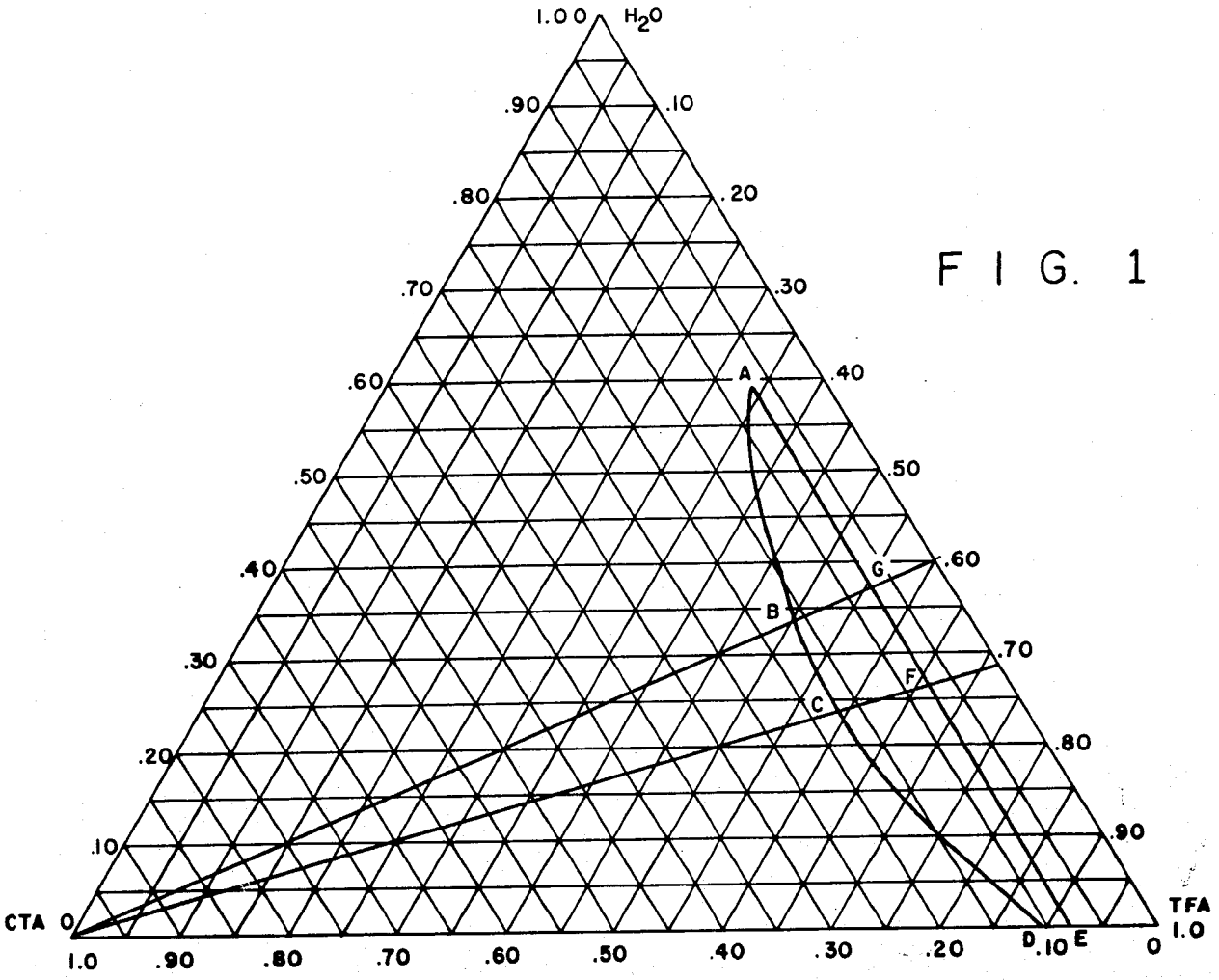
FIGS. 1, 2 and 3 are ternary phase diagrams constructed for the systems comprising cellulose triacetate/trifluoroacetic acid/water, cellulose triacetate/trifluoroacetic acid/methylene chloride and cellulose triacetate/trifluoroacetic acid/formic acid.

Inherent viscosity is calculated using the formula:

$$\text{Inherent viscosity, } \eta_{inh} = (\ln \eta_{rel})/C$$

where C is the polymer concentration in g. polymer per deciliter solvent. The relative viscosity ($\eta_{rel}$) is determined by measuring the flow time in seconds using a standard viscosimeter of a solution of 0.5 g of the polymer in 100 ml. hexafluoroisopropanol at 30° C. and dividing by the flow time in seconds for the pure solvent. The units of inherent viscosity are dL/g.

Acetyl content of cellulose acetate is determined by ASTM method D-871-72 (reapproved 1978) Method B.

Filament tensile properties were measured using a recording stress-strain analyzer at 70° F. (21.1° C.) and 65% relative humidity. Gauge length was 1.0 in (2.54 cm), and rate of elongation was 10%/min. Results are reported as T/E/M in dN/tex units, T is break tenacity in dN/tex, E is elongation-at-break expressed as the percentage by which initial length increased, and M is initial tensile modulus in dN/tex. Average tensile properties for three to five filament samples are reported. The test is further described in ASTM D2101 part 33, 1980.

The tex of a single filament is calculated from its fundamental resonant frequency, determined by vibrating a 7 to 9 cm. length of fiber under tension with changing frequency. (A.S.T.M. D1577-66, part 25, 1968) This filament is then used for 1 break.

Orientation Angle (OA)

A wide angle X-ray diffraction pattern (transmission pattern) of the fiber is obtained using a Warhus pinhole camera (0.635 mm pinhole diameter) with a sample-to-film distance of 5 cm.; a vacuum is created in the camera during the exposure. A Philips X-ray generator with a copper fine-focus diffraction tube and a nickel betafilter is used, operated at 40 kv and 40 ma. The fiber sample consists of a bundle approximately 0.5 mm thick; all the filaments in the X-ray beam are kept essentially parallel. The diffraction pattern is recorded on Kodak No- Screen medical X-Ray film (NS-54T) or equivalent. The film is exposed for a sufficient time to obtain a pattern in which the diffraction spot to be measured has a sufficient photographic density, e.g., between 0.4 and 1.0, to be accurately readable.

The arc length in degrees at the half-maximum density (angle subtending points of 50 percent of maximum density) of the strong equatorial spot at about 8° of 20 is measured and taken as the orientation angle (OA) of the sample. The measurement is performed by a densitometer method. The azimuthal density distribution of the diffraction arc is obtained by use of a Leeds & Northrup Microphotometer (Catalog No. 6700-P1) whose electronic components have been replaced by a Keithley 410 Micro-Microammeter (Keithley Instruments Inc., Cleveland, Oh.). The output of this apparatus is fed to a Leeds & Northrup Speedomax Recorder, Type G.

After careful centering of the film on the stage, the stage and mounted film are moved to permit the light beam to pass through the most dense area of the diffraction spot; the opposite spot is checked to insure true centering. The azimuthal density trace through at least a 360° rotation of the film is then recorded. The obtained curve has two major peaks. A base line is drawn for each peak as a straight line tangential to the minima on each of the peaks. A perpendicular line is dropped from each peak maximum to the base line. On this perpendicular at a density (the "half-density" point) equal to the average of the density at the peak maximum and the density where the base line intersects the perpendicular, is drawn a horizontal line which intersects each leg of the respective curves. The leg-to-leg lengths of the half-density horizontal lines are converted to degrees and averaged to give the orientation angle referred to herein. Values determined by this method have been shown to be precise to ±0.7° at the 95 percent probability level.

Activation Procedure

In order to reduce unwanted chain scission, cellulose activation is preferably carried out under mild conditions as shown in Table 1 which permits acetylation at −40° C. to 28° C., providing cellulose triacetate with inherent viscosities above 5.0 from cotton linters, combed cotton or lignin free wood pulp. Although cellulose preactivation was not necessarily required for high temperature acetylation reactions (40°–80° C.) it was found to be essential for success at low temperatures.

In the simplest preactivation process, the cellulose materials (150 g) were boiled in distilled water (4 L) under nitrogen for 1 h. The mixture was allowed to cool to room temperature, the cellulose was collected by suction filtration and pressed out using a rubber diaphragm. It was resuspended in cold water for 15 minutes, isolated again and then immersed in glacial acetic acid (3 L) for 2–3 minutes and pressed out as before. A second glacial acetic acid wash was performed, the acid pressed out, and the damp cotton immediately placed in a prechilled acetylation medium.

Several alternative activation processes are shown in Table 1.

Acetylation Procedure

For the acetylation process a 4 L resin kettle fitted with a Hastealloy C eggbeater type stirrer and a thermocouple was charged with acetic anhydride, 1 L; glacial acetic acid, 690 mL; and methylene chloride; 1020 mL. The reactants were cooled externally to −25° to −30° C. using a solid carbon dioxide/Acetone bath and the pre-activated cellulose (wet with acetic acid) was added. The reactants were then chilled to −40° C. in preparation for catalyst addition.

Acetic anhydride, 450 mL, was chilled to −20° to −30° C. in a 1 L erlenmeyer flask containing a magnetic stirring bar. Perchloric acid (60% aqueous solution, 10 mL) was added dropwise over 5–10 minutes with vigorous stirring while keeping the temperature below −20° C. Because of the strong oxidizing capability of perchloric acid in the presence of organic matter the catalyst solutions should be made and used at low temperature.

The catalyst solution was poured in a steady stream into the vigorously stirring slurry at −40° C. After addition was complete and the catalyst thoroughly dispersed the reactants were allowed to warm to −20° to −25° C. with stirring. At these temperatures the reaction was slow and it was difficult to detect an exotherm. However within 2–6 h the consistency of the slurry changed and the pulp began to swell and break up. After stirring for 4–6 h the reaction vessel was transferred to a freezer at −15° C. and allowed to stand overnight. By morning the reactants had assumed the appearance of a thick, clear gel which on stirring behaved as a typical non-Newtonian fluid (climbed the stirrer shaft). At this time a small sample was precipitated by pouring into methanol (at −20° C.) using a high speed electric blender with a nitrogen purge and then collected by suction filtration. A small portion was blotted to remove excess methanol and checked for solubility in methylene chloride or 100% trifluoroacetic acid. The absence of solution gel particles after 5–10 minutes indicated that reaction was complete and that the bulk polymer was ready for workup. Additionally a portion of the reaction mixture was examined microscopically between crossed polarizers for the possible presence of unreacted fibers which appeared as discrete birefringent domains. If the reaction was not complete the reactants were allowed to stir at −15° to −20° C. and checked every hour for solubility until clear solutions were obtained.

The thick, clear solution was then precipitated batchwise into cold methanol (6 L at −20° C.) using a high speed blender. The highly swollen particles were filtered onto two layers of cheesecloth using suction and pressed out. The resultant mat was then broken up and immersed in acetone (3 L) for a few minutes and then pressed out in order to remove any residual methylene chloride. The white flake was subsequently washed using the following sequence:

4 —5% Sodium Bicarbonate, once,
4 L—Water, twice,
3 L—Acetone, twice

The product was then placed in shallow pans and allowed to dry in air overnight. Yields were 230–250 g.

Properties of the triacetate polymer are shown in Table I. The process provides cellulose triacetate with at least 42.5% by weight of acetyl groups, preferably at least 44% (theoretical value 44.8%).

TABLE I

| | | ACTIVATION METHOD | REACTION TEMPERATURE (°C.) | $\eta_{inh}$ | % Acetyl |
|---|---|---|---|---|---|
| A | Cotton | Boil 1 hr. | −20 to −14 | 6.3 | 44.9 |

TABLE I-continued

| | | ACTIVATION METHOD | REACTION TEMPERATURE (°C.) | $\eta_{inh}$ | % Acetyl |
|---|---|---|---|---|---|
| | Linters | in water | | | |
| B | Cotton Linters | Boil 2 hrs. in water | −20 to −10 | 7.0 | 42.6 |
| C | Wood Pulp (Floranier F) | Boil 2 hrs. in water | −24 to −15 | 5.9 | 44.4 |
| D | Cotton Linters | Boil 1 hr. in water | −24 to −15 | 6.3 | 44.0 |
| E | Combed Cotton | Extract with ethanol Boil 12 h 1% NaOH Wash, Neutralize 1% acetic acid | −32 to 6 | 6.7 | 45.1 |
| F | Cotton Linters | boil 1 hour 1% NaOH | −15 to −5 | 6.0 | 43.5 |
| G | Cotton Linters | Soak 3 days in 2.65 L water containing 750 g. urea and 18.2 g. $(NH_4)_2SO_4$ | +19 to +28* | 6.2 | 42.7 |
| H | Wood Pulp (Ultranier J) | Boil 2 hrs. in water | −40 to −25 | 4.8 | 44.0 |

*heterogeneous acetylation

Solution Preparation

Figure 2:
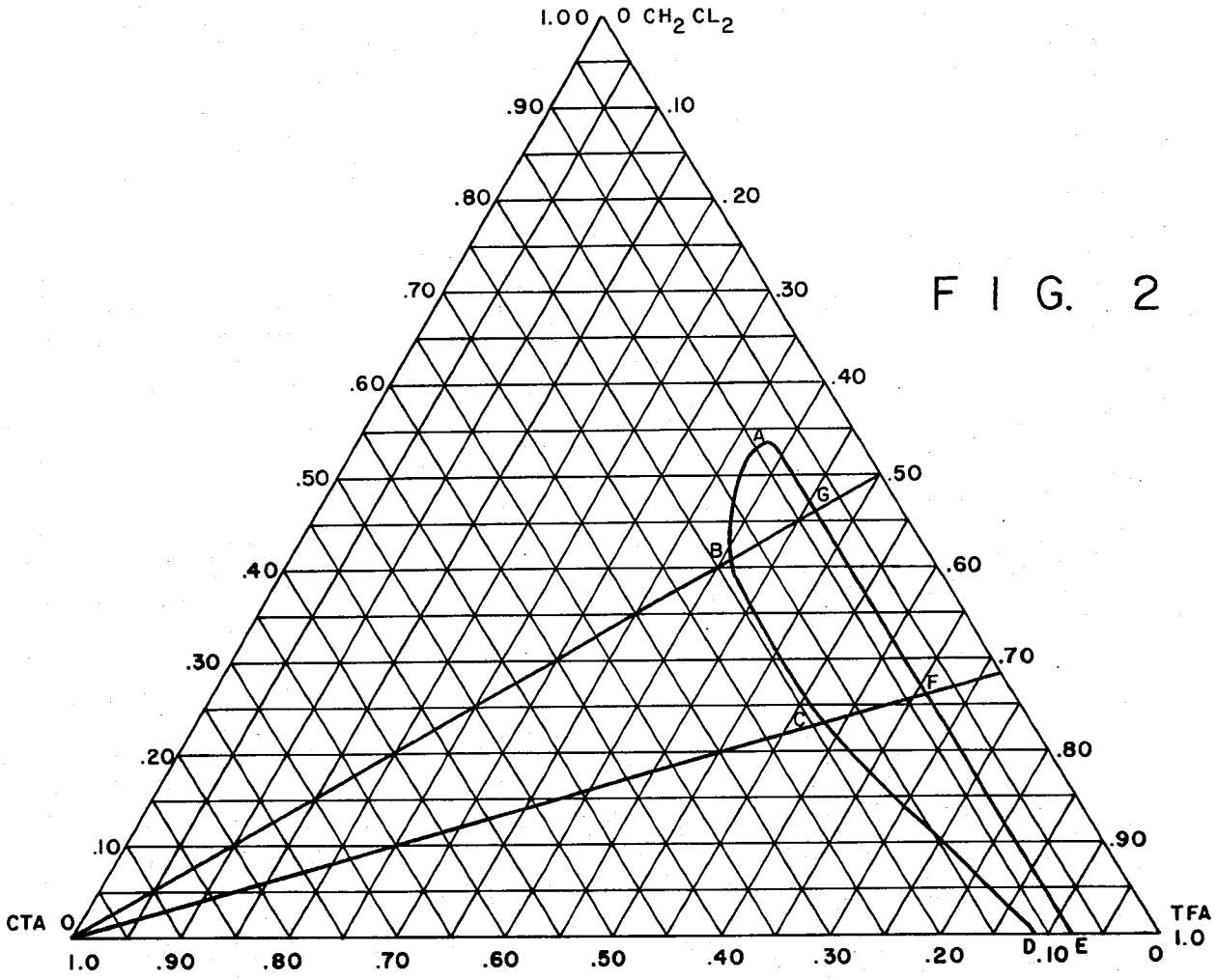
Figure 3:
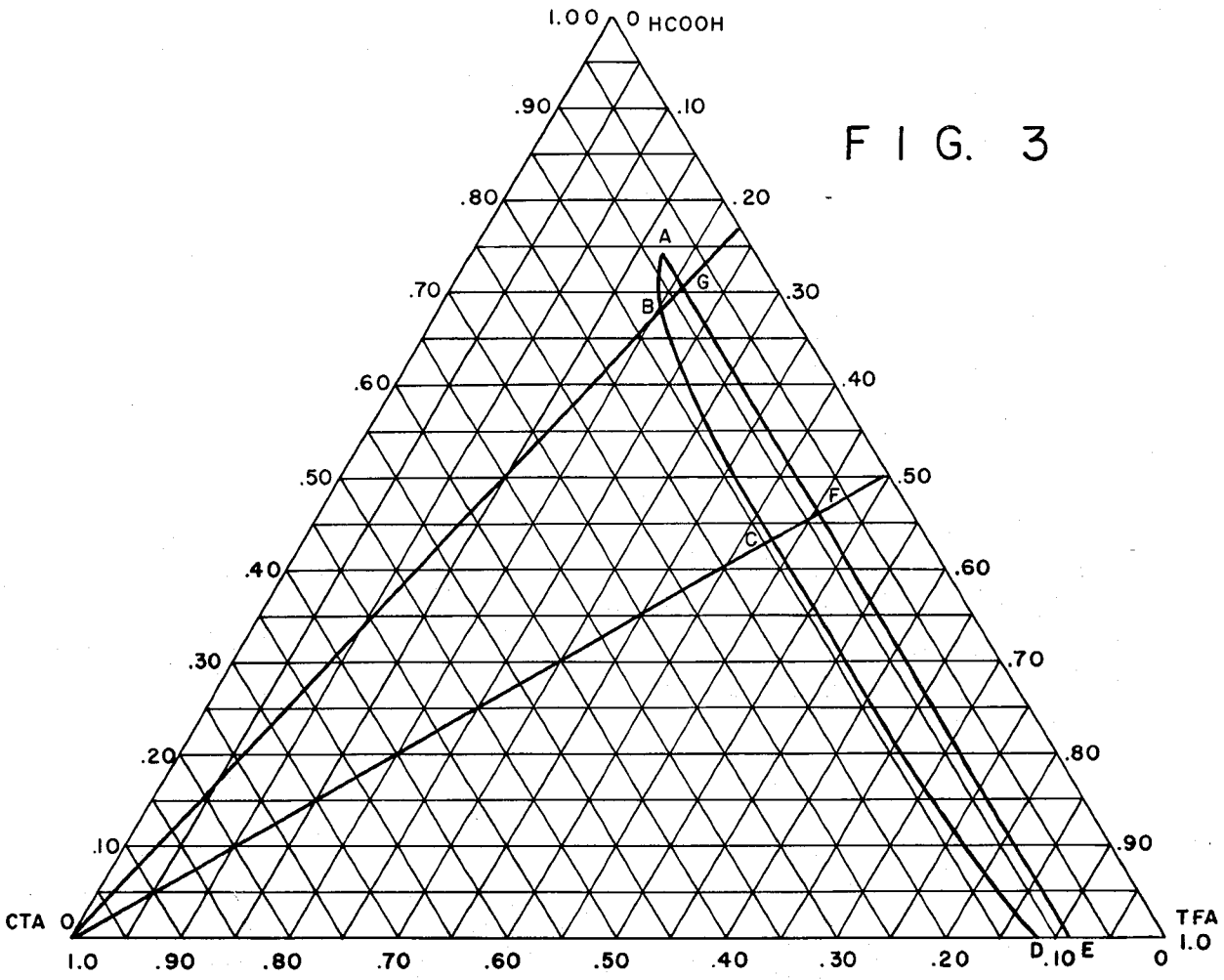

The FIGS. 1, 2 and 3 each show an area wherein optically anisotropic solutions are available with solvent mixtures of certain compositions. The figures further show areas within the anisotropic areas which are capable of providing good spinnability from high solids solutions and which have been found to provide fibers having high tenacity and modulus.

The diagrams were constructed using qualitative observations to determine solubility. The homogeneous solutions were judged anisotropic if samples sandwiched between a microscope slide and cover slip were birefringent when viewed between crossed polarizers. All observations were taken at room temperature after mixing the solutions and allowing them to stand for 24 hours. A sample was classified as borderline if greater than about 80–90% of the polymer was in solution, but microscopic examination revealed some incompletely dissolved particles. The areas bounded by points ABCDEFG are areas of complete solubility which are anisotropic. The areas BCFG enclose areas of solution composition suitable for use in the present invention. The axes are graduated directly in mole fractions so that for any point on the diagram molar ratios can be determined. Moles of cellulose triacetate are calculated in terms of glucose triacetate repeat units (unit weight=288.25) and labeled on the figures as mole fraction GTA.

It is apparent from FIG. 1 that there is a relatively narrow compositional range over which anisotropic solutions are obtained. In the cellulose triacetate/trifluoroacetic acid/water (GTA/TFA/$H_2O$) system, maximum polymer solubility is achieved at a TFA/$H_2O$ mole ratio of about 2. This corresponds to mole fractions GTA:TFA:$H_2O$ of 0.17:0.55:0.28 or 42 wt. percent GTA based on glucose triacetate repeating units.

In practice optimum spinnability and the desired fiber properties were obtained by using 30 to 42% GTA solutions in TFA/$H_2O$ at molar ratios of 1.5–2.5. In the figure, a solvent molar ratio of 1.5 appears as line BG which represents a TFA mole fraction of 0.60 and a solvent molar ratio of 2.5 appears as line CF which represents a TFA mole fraction of 0.714 with respect to the solvent alone.

FIG. 2 is a ternary phase diagram prepared for the system GTA/TFA/$CH_2Cl_2$ using the procedure as previously outlined. As in the GTA/TFA/$H_2O$ system, solubility is significantly enhanced as the glucose triacetate unit:solvent stoichiometry converges on a 0.17:0.83 mol ratio. The optimum spinnability and high tensile properties are obtained at 35 to 42% solids in solutions wherein the molar ratio of TFA/$CH_2Cl_2$ is 1.0 to 2.5 which corresponds to mol fractions of TFA of 0.50 to 0.714 as shown in the figure.

FIG. 3 is the ternary phase diagram prepared for a GTA/TFA/HCOOH system using the procedure as previously outlined. As in the previous example, polymer solubility is significantly enhanced as the polymer:solvent stoichiometry converges on 0.15:0.85 mol ratio. The figure is constructed using mixtures of TFA in combination with formic acid (98–100% by weight) assuming 100% formic acid. As shown in the figure, formic acid is not a sufficiently good solvent for commercial cellulose triacetate polymer to achieve high solids anisotropic solutions. On the other hand, mixtures of TFA and formic acid at molar ratios of 0.3 to 1.0 are excellent solvents (mole fraction TFA of 0.23 to 0.50). Optimum spinnability and tensile properties are obtained with the stated solvent molar ratios at 35 to 42% solids by weight.

Spinning

Figure 4:
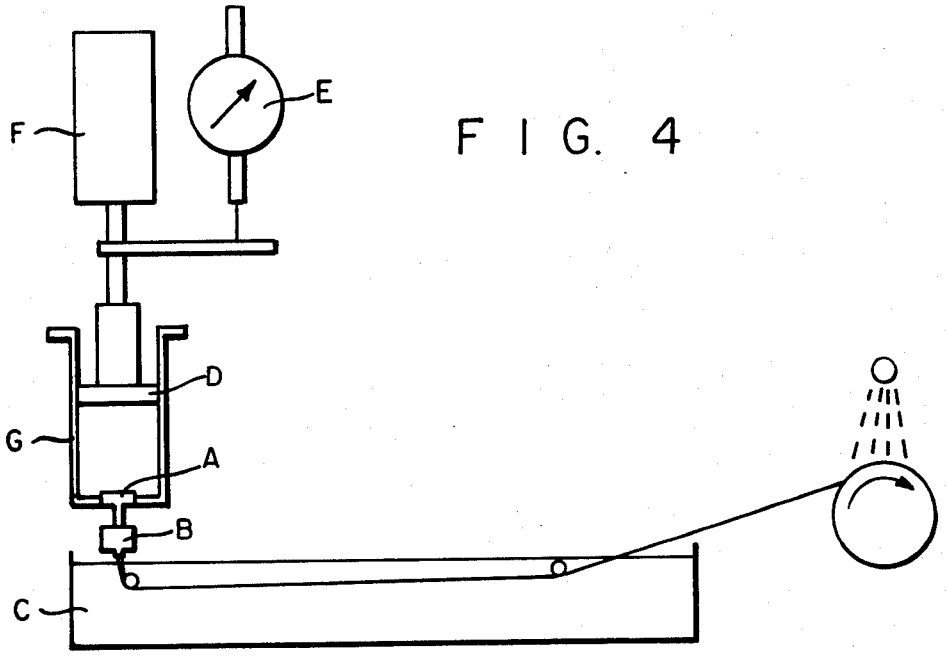
FIG. 4 is a schematic diagram of apparatus for air-gap spinning of anisotropic solutions of cellulose triacetate.

High solids, anisotropic solutions of cellulose triacetate were air-gap-spun into cold methanol using apparatus shown in FIG. 4. A piston (D) activated by hydraulic press (F) and associated with piston travel indicator (E) was positioned over the surface of the dope, excess air expelled from the top of the cell and the cell sealed. The spin cell (G) was fitted at the bottom with the following screens (A) for dope filtration—2X 20 mesh, 2X 100 mesh, 1 "Dynalloy" (X5), 2X 100 mesh and 2X 50 mesh. The filtered dope then passed into a spinneret pack (B) containing the following complement of screens—1X 100 mesh, 2X 325 mesh, 2X 100 mesh and a final 325 mesh screen fitted in the spinneret itself. Dopes were extruded through an air gap at a controlled rate into a static bath (C) using a Zenith metering pump to supply hydraulic pressure at piston D. The partially coagulated yarn was passed around a 9/16" diameter "Alsimag" pin, pulled through the bath, passed under a second pin and wound up. Yarn was washed continuously on the windup bobbin with water, extracted in water overnight to remove residual TFA and subsequently air dried. The spinning parameters are given in Table 2.

Excellent fiber properties were realized with spin bath temperatures in the range of −1° C. to −33° C. and spin-stretch factors between 2.0–7.6 using cellulose triacetate derived from polymers A, B, C, D and E of Table I. Polymer F, which was prepared from cellulose activated in 1% NaOH, gave somewhat poorer properties, but still superior to the properties of prior art cellulose triacetate fibers. Good fiber properties might not be obtained if less than optimum spinning conditions are used. With the equipment used (maximum cell pressure=800 lbs/in$^2$ (56.2 kg./cm.$^2$) typically attainable jet velocities were in the range of 15–50 ft/min (4.57–15.2 m/min). It was possible to increase jet velocity by localized warming at the spinneret (up to 40° C.). Liquid crystalline solutions may revert to an isotropic state when heated above a certain critical temperature and optimum spinnability and fiber tensile properties are obtained only below this temperature.

Filament tensile properties for as-spun cellulose triacetate are given in Table 3. In general, the filaments exhibit a slight yield at 1–2% elongation under tension after which the curve becomes essentially linear to failure. It should be noted that macroscopic defects in filaments can cause poorer tensile properties to be obtained even when a satisfactory low orientation angle is obtained. Spinning conditions can have an important effect on tensile properties, e.g., tenacity, on a macroscopic scale. The macroscopic effect can be detected by testing filaments at a number of different gauge lengths on the tensile tester.

Heat Treatment of Cellulose Triacetate Fibers

Table 4 shows suitable conditions for heat treating the cellulose triacetate yarn. The cellulose triacetate yarns were spun as shown in Table 2 but in some instances the treated yarns were derived from different bobbins of the spins indicated in Table 2. It should be noted that the yarn is treated under tension. Tension can provide 1–10% stretch in the yarns. Simple annealing in skein form does not provide the high tenacity yarns of the invention, i.e., yarns with tenacity above 10.6 dN/tex. The apparatus for heat treatment consisted of a conventional steam tube capable of saturated steam pressure of up to 7 kg/cm$^2$ between feed and draw rolls. The steam in the treatment chamber was kept at 4.22 to 6.33 kg/cm$^2$ (gauge) ($5.15\times10^5$-$7.22\times10^5$ Pascals absolute). For heat treatment in superheated steam a modified steam tube fed with superheated rather than saturated steam was used.

TABLE 2

| Spin | Polymer | $\eta_{inh}$ | % Solids | Solvent | Solvent mole Ratio | air gap (cm.) | Spinneret Holes no. dia. mm | Bath Temp, °C. | Extrusion Rate m/min | Wind-up Speed (m/min) |
|---|---|---|---|---|---|---|---|---|---|---|
| 1 | E | 6.7 | 35 | TFA/$CH_2Cl_2$ | 1.25 | 2.54 | 20/.076 | −30 | 1.52 | 7.0 |
| 2 | A | 6.3 | 35 | TFA/$H_2O$ | 1.97 | 2.54 | 40/.076 | −26 | 6.4 | 12.8 |
| 3 | C | 5.9 | 38 | TFA/$H_2O$ | 1.97 | 3.81 | 40/.076 | −33 | 4.27 | 26.0 |
| 4 | B | 7.0 | 35 | TFA/$H_2O$ | 1.97 | 3.81 | 20/0.152 | −1 | 1.6 | 8.4 |
| 5 | D | 6.3 | 38 | TFA/$H_2O$ | 1.97 | 2.54 | 40/.076 | −19 | 3.35 | 10.1 |
| 6 | F | 6.0 | 40 | TFA/$H_2O$ | 1.97 | 2.54 | 20/0.152 | −16 | 1.07 | 8.1 |
| 7 | F | 6.0 | 35 | TFA/$H_2O$ | 1.97 | 2.54 | 40/.076 | −22 | 4.57 | 6.8 |
| 8 | F | 6.0 | 25 | TFA/$H_2O$ | 1.97 | 1.75 | 20/.076 | −20 | 15.2 | 25.8 |
| 9 | F | 6.0 | 20 | TFA/$H_2O$ | 1.97 | 2.54 | 20/.076 | −25 | 26.2 | 16.8 |
| 10 | E | 6.7 | 35 | TFA/$CH_2Cl_2$ | 1.25 | 4.44 | 40/.076 | −20 | 3.1 | 6.2 |
| 11 | C | 5.9 | 38 | TFA/$H_2O$ | 1.97 | 1.91 | 40/.076 | −20 | 4.6 | 6.0 |
| 12 | G | 6.2 | 40 | TFA/$CH_2Cl_2$ | 1.25 | 2.54 | 40/0.076 | −32 | 5.2 | 22.9 |
| 13 | D | 6.3 | 35 | TFA/HCOOH | 1.0 | 2.54 | 40/0.076 | −25 | 4.9 | 11.9 |
| 14 | D | 6.3 | 38 | TFA/$H_2O$ | 1.97 | 2.54 | 40/0.076 | −24 | 4.87 | 12.2 |
| 15 | A | 6.3 | 35 | TFA/$H_2O$ | 1.97 | 2.54 | 40/0.076 | −27 | 3.96 | 9.4 |
| 16 | B | 7.0 | 35 | TFA/$H_2O$ | 1.97 | 3.81 | 20/0.152 | −25 | 0.98 | 8.3 |
| 17 | I* | 3.9 | 23 | TFA/$CH_2Cl_2$ | 15.8 | 1.27 | 20/0.076 | −19 | 16.2 | 35.6 |

*Eastman Cellulose Triacetate No. 2314

TABLE 3

| Spin | Polymer | $\eta_{inh}$ | OA | As Spun T/E/Mi (dN/tex) | Spin | Polymer | $\eta_{inh}$ | OA | As Spun T/E/Mi (dN/tex) |
|---|---|---|---|---|---|---|---|---|---|
| 1 | E | 6.7 | 28 | 10.2/6.7/175 | 10 | E | 6.7 | 28 | 8.9/7.9/148 |
| 2 | A | 6.3 | 30 | 12.7/9.7/179 | 11 | C | 5.9 | 30 | 7.7/9.3/128 |
| 3 | C | 5.9 | 22 | 10.2/8.2/154 | 12 | G | 6.2 | 22 | 7.3/7.6/147 |
| 4 | B | 7.0 | 30 | 11.9/11.4/147 | 13 | D | 6.3 | 32 | 8.2/9.1/124 |
| 5 | D | 6.3 | 31 | 13.3/10.6/181 | 14 | D | 6.3 | 28 | 8.2/9.6/106 |
| 6 | F | 6.0 | 27 | 8.2/9.5./105 | 15 | A | 6.3 | 31 | 10.4/10.8/132 |
| 7 | F | 6.0 | 25 | 7.1/9.0/103 | 16 | B | 7.0 | 30 | 11.1/8.2/143 |
| 8 | F | 6.0 | 35 | 5.0/7.7/117 | 17 | I* | 3.9 | 38 | 5.4/10.8/95 |
| 9 | F | 6.0 | 45 | 1.6/10.9/96 | | | | | |

TABLE 4

HEAT TREATMENT OF CELLULOSE TRIACETATE AND REGENERATED CELLULOSE IN STEAM

| Spin No. | Rate (m/min) Feed | Rate (m/min) Wind-Up | Draw Ratio | Tension (g) | Tex | Steam Pressure (kg/cm$^2$) (gauge) | Temp. (°C.) | OA After | T/E/Mi (dN/tex) Before | T/E/Mi (dN/tex) After |
|---|---|---|---|---|---|---|---|---|---|---|
| | | | | A. CELLULOSE TRIACETATE | | | | | | |
| 12 | 5.49 | 5.76 | 1.05 | 200 | 20.4 | 4.9 | 158 | 12 | 6.8/8.7/127 | 11.5/5.4/247 |
| 14 | 3.20 | 3.35 | 1.05 | 500 | 33.3 | 0.21 | 234* | 12 | 10.4/10.8/133 | 12.6/6.1/198 |
| 5 | 2.44 | 2.59 | 1.06 | 300 | 32.0 | 5.6 | 162 | 13 | 13.3/10.6/181 | 12.8/6.4/212 |
| 4 | 2.44 | 2.51 | 1.03 | 450 | 46.4 | 5.6 | 162 | 13 | 11.9/11.4/147 | 11.8/6.1/213 |
| | | | | B. REGENERATED CELLULOSE | | | | | | |
| 15 | 0.91 | 0.94 | 1.03 | 500 | 21.8 | 0.21 | 137* | 9 | 10.0/5.2/307 | 15.1/5.9/364 |

TABLE 4-continued

HEAT TREATMENT OF CELLULOSE TRIACETATE AND REGENERATED CELLULOSE IN STEAM

| Spin No. | Rate (m/min) Feed | Rate (m/min) Wind-Up | Draw Ratio | Tension (g) | Tex | Steam Pressure (kg/cm$^2$) (gauge) | Temp. (°C.) | OA After | T/E/Mi (dN/tex) Before | T/E/Mi (dN/tex) After |
|---|---|---|---|---|---|---|---|---|---|---|
| 15 | 1.52 | 1.60 | 1.05 | 175 | 21.8 | 0.21 | 106* | 7 | 10.0/5.2/307 | 15.0/6.9/300 |

*superheated steam

Saponification of Cellulose Triacetate to Cellulose

The triacetate yarns were converted to regenerated cellulose by saponification in sealed containers at room temperature which had been purged with nitrogen before sealing. The saponification medium was 0.05 molar sodium methoxide in methanol. Skeins of yarn were treated at room (RT) or at the temperature shown in Table 5 for several hours. The properties of the cellulose triacetate precursor and the regenerated cellulose filaments are shown in Table 5.

TABLE 5

Tensile Properties of As-Regenerated Cellulose Fibers from Anisotropic Triacetate Precursors

| Spin | Time (h) | Temp. (°C.) | As-Spun T/E/Mi (dN/tex) | As Regenerated T/E/Mi (dN/tex) | OA |
|---|---|---|---|---|---|
| 10 | 93 | RT | 8.9/7.9/148 | 16.4/9.1/301 | 11 |
| 16 | 71 | RT | 11.1/8.2/143 | 14.3/8.4/275 | 12 |
| 2 | 4 | 60 | 12.7/9.7/179 | 13.1/8.4/220 | 12 |
| 11 | 70 | RT | 7.7/9.3/128 | 12.8/8.2/264 | 13 |

Heat Treatment of Regenerated Cellulose Yarns

The properties of regenerated cellulose yarns, may be improved by heat treating in steam as shown in Table 4. The filaments reported in Table 4 are from different spins than those reported in Table 5. However it should be noted that both the regeneration step and the subsequent heat treatment are effective in increasing tenacity.

What is claimed is:

1. Process for preparing high strength cellulose triacetate fibers having at least 42.5% by weight acetyl groups by extruding a solution of cellulose triacetate in a solvent mixture comprising an organic acid having a pKa of no more than 3.5 and another solvent having a molecular weight of less than 160 through an inert non-coagulating fluid layer into a coagulating bath wherein the cellulose triacetate has an inherent viscosity of at least 5 (0.5 g/dL in hexafluoroisopropanol at 30° C.), the polymer concentration is 30–42% by weight, and the mol ratio of organic acid to the other solvent is 0.3 to 3.0.

2. Process of claim 5 wherein the organic acid is trifluoroacetic acid.

3. Process of claim 8 wherein the other solvent is selected from the group consisting of water, methylene chloride and formic acid.

4. Process of claim 9 wherein the other solvent is water, the mol ratio of trifluoroacetic acid to water is 1.5 to 2.5 and the polymer concentration is 35–42% by weight.

5. Process of claim 9 wherein the other solvent is methylene chloride, the mol ratio of trifluoroacetic acid to methylene chloride is 1.0 to 2.5 and the polymer concentration is 34–42% by weight.

6. Process of claim 9 wherein the other solvent is formic acid, the mol ratio of trifluoroacetic acid to formic acid is 0.3 to 1.0 and the polymer concentration is 34–42% by weight.

7. Process of claim 9 wherein the coagulation bath is a 1–3 carbon atom alcohol or diol.

8. Process of claim 13 wherein the coagulating bath is methanol.

9. Process for increasing the strength and modulus of fibers produced by the process of claim 7 wherein the fibers are subsequently drawn 1–10% in steam.

* * * * *

UNITED STATES PATENT OFFICE

CERTIFICATE OF CORRECTION

PATENT NO. : 4,464,323

DATED : August 7, 1984

INVENTOR(S) : O'Brien

It is certified that error appears in the above-identified patent and that said Letters Patent are hereby corrected as shown below:

Column 10, line 21: the claim reference numeral "5" should read --1--;

Column 10, line 23: the claim reference numeral "8" should read --2--;

Column 10, lines 26, 30, 34 and 38: the claim reference numeral "9" should read --3--, each occurrence;

Column 10, line 40: the claim reference numeral "13" should read --7--;

Column 10, line 43: the claim reference numeral "7" should read --1--.

Signed and Sealed this

*Twenty-sixth* Day of *February 1985*

[SEAL]

*Attest:*

DONALD J. QUIGG

*Attesting Officer* *Acting Commissioner of Patents and Trademarks*